United States Patent [19]

Newberger

[11] Patent Number: 4,744,565

[45] Date of Patent: May 17, 1988

[54] FISH SWALLOWING GAME

[76] Inventor: Judah Newberger, 134 Kingsley Ave., Staten Island, N.Y. 10314

[21] Appl. No.: 824,151

[22] Filed: Jan. 30, 1986

[51] Int. Cl.[4] ..... A63F 9/00

[52] U.S. Cl. ..... 273/342; 273/1 G; 273/1 GG; 273/350; 273/400; 210/776; 210/242.1

[58] Field of Search ..... 273/350, 342, 16, 400, 273/401, 402, 1 G, 1 GG; 210/169, 776, 255, 242.1; 4/490; 272/1 B; 446/304

[56] References Cited

U.S. PATENT DOCUMENTS

| | | | |
|---|---|---|---|
| 1,199,183 | 9/1916 | Hill | 446/304 |
| 2,989,185 | 6/1961 | Lombardi | 210/776 |
| 3,751,030 | 8/1973 | Winters | 272/1 B |

OTHER PUBLICATIONS

The Sporting Goods Dealer, 5-1973, p. 145, Scoop Game.

*Primary Examiner*—Paul E. Shapiro
*Attorney, Agent, or Firm*—Stiefel, Gross, Kurland & Pavane

[57] ABSTRACT

A method of playing a fish swallowing game comprises the steps of placing a hollow fish shaped receptacle (10) in water, with the receptacle (10) having a mouth opening (16) which is placed in water so as to be partly depressed below the level (22) of the water and at an angle with respect thereto for collecting water therethrough. The opening (16) is partly depressed for ensuring that the water level (24) of any collected water flowing into the receptacle (10) will be below the water level (22) of the water in which the receptacle (10) has been placed for creating a waterfall effect flow (28) of collected water from the water level (22) of the water in which the receptacle (10) has been placed to the water level (24) of any collected water in the interior (14) of the receptacle (10). The opening (16) has a diameter slightly larger than the diameter of the fish shaped objects (12) in the water so as to limit the collection of the objects (12) to one at a time through the opening (16). The smaller fish (12) are drawn into the interior of the larger fish (10) through the opening (16) along with the collected water due to the waterfall flow effect of the collected water (28). The larger fish (10) may be externally squeezed to create a partial vacuum within the interior (14) to further aid in capturing the fish (12) through the restricted opening (16). The larger fish (10) may also be used on dry land or in connection with supplementary targets (42, 44) to enhance the game.

20 Claims, 5 Drawing Sheets

FISH SWALLOWING GAME

TECHNICAL FIELD

The present invention relates to a game, particularly to a fish swallowing game in which a larger fish is used to capture or swallow smaller fish within the interior thereof.

BACKGROUND ART

Fish capture games are well known in the art, such as disclosed in U.S. Pat. Nos. 3,106,394 and 4,272,913 as are other types of aquatic toys such as disclosed in U.S. Pat. Nos. 3,473,254 and 4,515,572. However, to applicant's knowledge, none of these aquatic toys or fishing games employs a waterfall effect to enable a large fish shaped receptacle to swallow or capture smaller fish. Moreover, no such fish games are known to applicant in which the game may also be played on dry land as well as in the water.

DISCLOSURE OF THE INVENTION

A method of playing a fish swallowing game comprises the steps of placing a hollow fish shaped receptacle in water, the receptacle having a mouth opening from the exterior thereof into the interior thereof, which mouth opening is placed in the water so as to be partly depressed below the level of the water and at an angle with respect thereto for collecting water therethrough, the mouth opening being partly depressed for ensuring that the water level of any collected water flowing into the fish shaped receptacle will be below the water level of the water in which the fish shaped receptacle has been placed for creating a waterfall effect flow of collected water from the water level of the water in which the fish shaped receptacle has been placed to the water level of any collected water in the interior of the fish shaped receptacle. Buoyant fish shaped objects are placed in the water adjacent the exterior of the fish shaped receptacle, with the objects having a dimension smaller than the mouth opening for enabling passage of the objects through the mouth opening. The fish shaped receptacle is moved so as to place the partly depressed mouth opening adjacent a buoyant fish shaped object and this fish shaped object is drawn into the receptacle hollow interior through the partly depressed mouth opening along with the collected water due to the waterfall flow effect of the collected water due to the difference of the two water levels between the receptacle exterior at the mouth opening and the collected water in the receptacle interior; whereby the fish shaped object is swallowed by the fish shaped receptacle. This step may be successively repeated for each fish shaped object until they're all swallowed or captured by the fish shaped receptacle. The fish shaped receptacle may comprise a squeezable material in which instance the drawing step further comprises the step of externally squeezing the adjacently placed fish shaped receptacle for creating a partial vacuum within the receptacle interior which aids in drawing the adjacent fish shaped object into the receptacle interior along with the collected water. The fish shaped receptacle may also be placed on dry land standing upright with the mouth opening at the top and fish shaped objects dropped into the receptacle through the mouth opening due to gravity. An array of targets of associated point value may be placed adjacent the upright standing fish shaped receptacle in which instance the dropping step further comprises the step of rebounding the fish shaped objects off of the receptacle exterior toward the targets, which may be containers, to score points by landing in one of the targets.

BEST MODE FOR CARRYING OUT THE INVENTION

Figure 1:
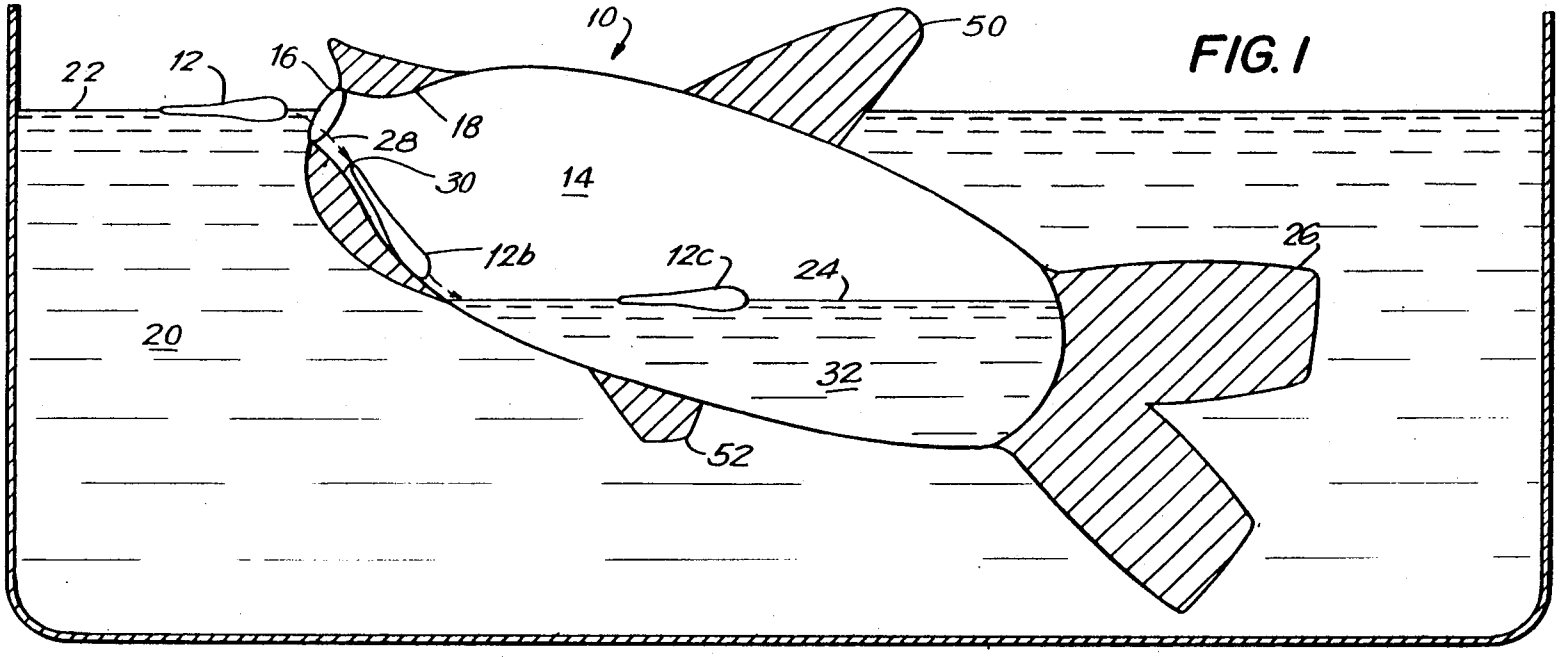
FIG. 1 is a sectional view, partially diagramatic, of the waterfall effect employed in playing the presently preferred game of the present invention.
Figure 5:
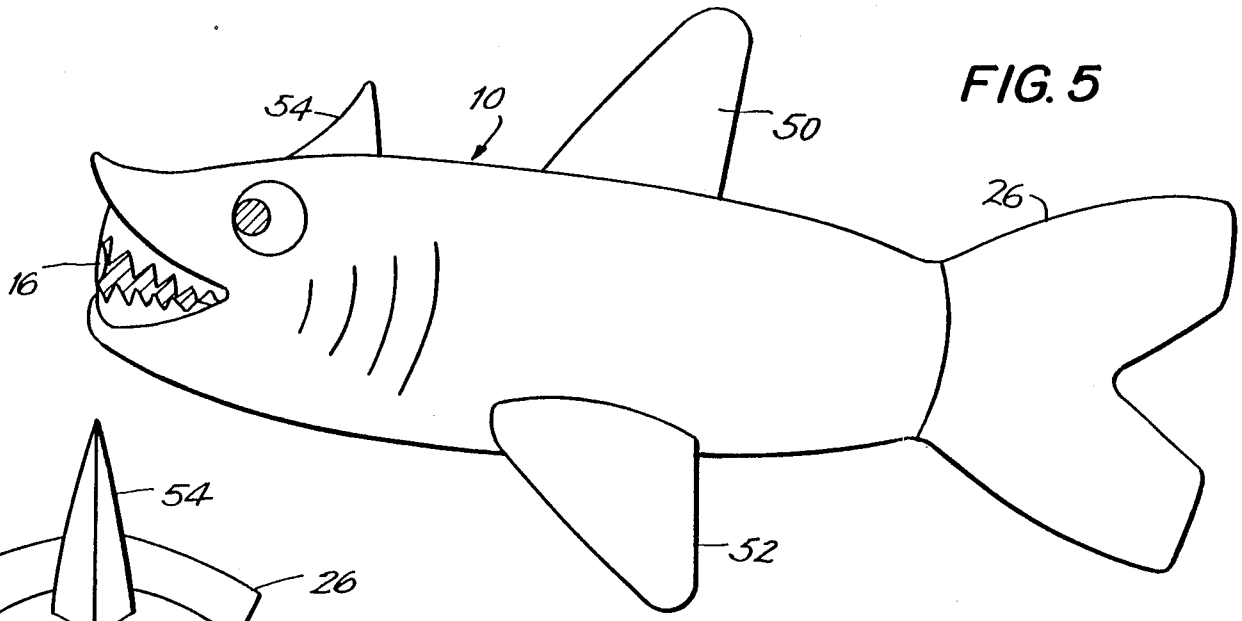
FIG. 5 and 6 are a side elevational and front elevational view, respectively, of the presently preferred form of the large fish shaped receptacle employed in playing the presently preferred game or method of the present invention.
Figure 6:
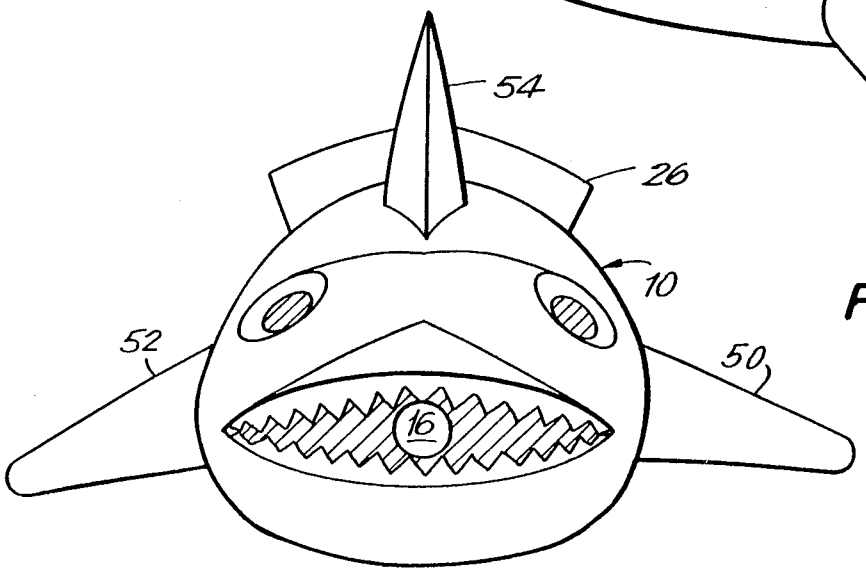
Figure 7:
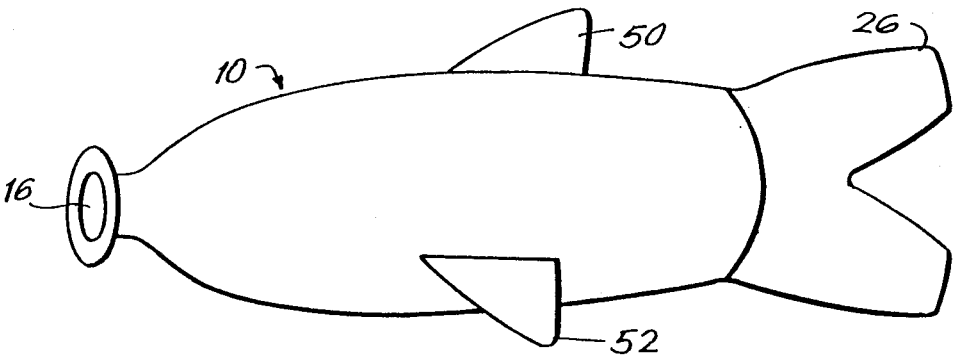
FIG. 7 is a side elevational view of an alternative embodiment of the fish shaped receptacle illustrated in FIGS. 5 and 6.
Figure 8:
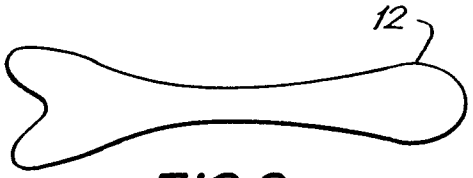
FIG. 8 and 9 are a top plan view and side elevational view, respectively, of a typical buoyant fish shaped object swallowed by the fish shaped receptacle of FIGS. 5 and 6, by way of example, during the playing of the presently preferred game or method of the present invention.
Figure 9:
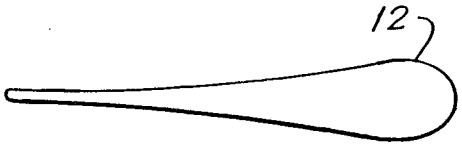

Referring now to the drawings in detail, and intially to FIG. 1 thereof, a large hollow fish shaped receptacle, generally referred to by the reference numeral 10, such as one in the shape of a shark as illustrated in FIGS. 5 and 6, is shown. The objective of the presently preferred game of the present invention is to have the large fish 10 swallow little fish floating in the water, such as a typical buoyant fish shaped object represented by reference numeral 12 in FIG. 1 and shown in greater detail in FIGS. 8 and 9. As illustrated in FIG. 1, the interior 14 of the large fish 10 is hollow, with the fish 10 having a mouth opening 16, such as a circular mouth opening, which provides a passageway from the exterior of the hollow fish shaped receptacle 10 to the interior 14 thereof. As further shown and preferred in FIG. 1, the opening 16 preferably communicates with a funnel shaped passageway 18 into the interior 14 of the fish shaped receptacle 10 which appears to help increase the water flow from the exterior of the fish shaped receptacle 10 to the interior 14 further enhancing the waterfall effect to be described hereinafter, and which helps in ejection of captured fish 12 from the interior 14.

In playing the presently preferred fish swallowing game of the present invention, the large fish shaped receptacle 10 is placed in a tub of water 20 with the mouth opening 16 being placed partly depressed below the top level 22 of the water 20 and preferably at a slight angle with respect to the top surface 22 for collecting water through the mouth opening 16. The partly depressed mouth opening 16 ensures that the water level of any collected water flowing into the fish shaped receptacle 10, represented by reference numeral 24 in FIG. 1, will be below the water level 22 of the water in which the large fish shaped receptacle 10 has been placed for creating a waterfall effect flow of collected water from the water level 22 of the water in which the fish shaped receptacle 10 has been placed to the water level 24 of the collected water in the interior 14 of the fish shaped receptacle 10. The little fish shaped objects 12 are preferably constructed from a suitable buoyant material which preferably will not cause captured fish 12 to cling or jam together in the interior 14, such as plastic, wood, compressed aluminum foil, rubber, hollow metal or some other buoyant material, and have an overall dimension which is smaller than the dimension of the mouth opening 16 so as to be readily passable therethrough, with the head size and tail size of the small fish 12 preferably sized for ease of entrance into and ejection from the interior of the large fish 10 through the mouth opening 16.

In playing the presently preferred fish swallowing game of the present invention, the large fish 10 is moved so as to place the partially depressed mouth opening 16 adjacent to or in close proximity with the little fish 12 with the balance of the body of the big fish 10, inclusive of the tail base portion 26 which is to be referred to later in describing the dry land based portion of the game, sufficiently depressed below the water level 22 in order to establish a potential difference of water level between water level 22 at the exterior of the mouth opening 16 and water level 24 in the interior of the large fish 10. This partial depression of mouth opening 16 below the water level 22 initiates water flow, represented by the dotted lines in FIG. 1 and given into the reference numeral 28, into the hollow interior 14 of the large fish 10. This water flow 28 creates a waterfall effect flow of collected water which draws the little fish 12 into a directed water current causing the little fish 12 to pass through the mouth 16 and be directed downwards along the bottom inner/surface 30 of the funnel shaped portion 18 to the progressively rising water level 24 of the collected water 32 within the interior of the big fish 10. The various stages in the swallow or capture of the fish 12 are illustrated in FIG. 1, with reference numeral **12*b* illustrating the small fish 12 drawn into the interior of the big fish 10 and directed along surface 30, and with reference numeral 12*c* illustrating the swallowed or captured fish floating within the interior 14 of the large fish 10 at water level 24. The flow of collected water 28 is a controlled flow of water so that a sustained flow is maintained in order to direct a plurality of such fish 12 into the interior 14 of the big fish 10 as the big fish 10 is successively moved adjacent each of the little fish 12** until they are all swallowed, thereby completing the game.

Figure 2:
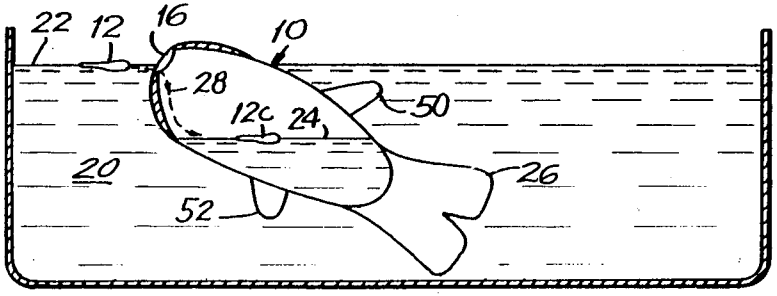
FIG. 2 is a front view, similar to FIG. 1, showing an alternative embodiment of the large fish which swallows the little fish in accordance with the presently preferred game or method of the present invention.

It should be noted, such as illustrated in FIG. 2, that the funnel shaped portion 18 of the large fish 10 is not required in playing the game and, instead, as illustrated in FIG. 2, the mouth opening 16 may open directly into the interior 14 of the large fish 10 without any funnel shaped portion 18 within the interior, with the aforementioned waterfall effect still occuring when the mouth opening 16 is partly depressed below the water level 22. The circular shaped of the mouth opening 16 preferably facilitates control of the incoming flow of water and facilitates ease of entry and ejection of little fish 12 through this mouth opening 16 although, if desired, other shapes can be employed for the mouth opening 16 in playing the presently preferred game of the present invention.

The housing or body of the big fish 10 may be constructed of any suitable material such a, for example, plastic, rubber, aluminum etc. and, if desired, may be constructed of a squeezable material, such as plastic or rubber, to aid in the drawing or capture process. In such an instance, after the partially depressed mouth opening 16 is placed adjacent the little fish 12 to be captured, the body of the large fish 10 may be externally squeezed to create a partial vacuum within the interior 14 of the large fish 10 further causing water from water level 22 to be sucked into the interior 14 of the large fish 10. This partial vacuum can work in conjunction with the waterfall effect or, if desired, can be used as an independent method of capturing the little fish 12.

Figure 3:
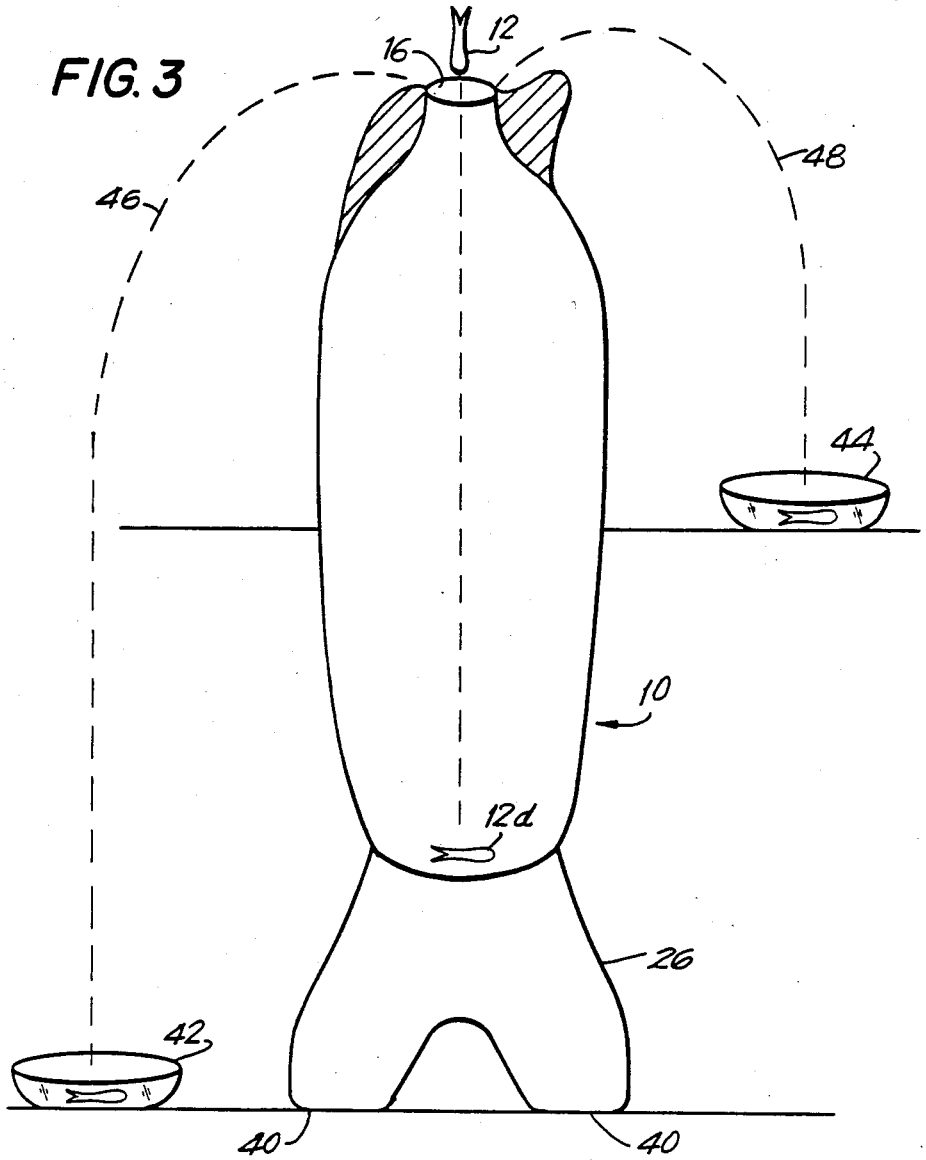
FIG. 3 is a diagramatic view, partially in section, illustrating the dry land version of the presently preferred game of the present invention.
Figure 4:
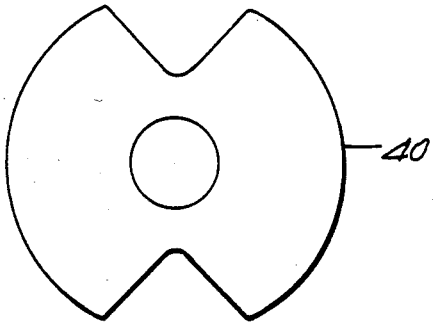
FIG. 4 is a bottom plan view of the large fish employed in FIG. 3.

As shown and preferred in FIGS. 3 and 4, the fish swallowing game of the present invention may be further enhanced by the ability to continue a variation of this game on dry land. In such an instance, the large fish 10 is preferably stood upright so as to rest on its tail portion 26 which preferably has a flattened base portion 40, illustrated in FIG. 4, so as to act as a secure stand for the balance of the fish 10. In this instance, preferably a plurality of targets in the form of containers 42, 44, by way of example, having different associated point values are placed adjacent the mouth opening 16, as shown by way of example in FIG. 4. The small fish 12 are then dropped towards the mouth opening 16 and enter mouth opening 16 by means of gravity to rest on the bottom of the interior, such as represented by reference numeral **12*d*. In addition, however, those little fish 12 which do not enter mouth opening 16 rebound off the exterior of the large fish 10 and, if directed correctly, will land in one of the target areas 42 or 44 to score the associated point value, with the rebound paths being illustrated by the dotted lines 46 and 48 in FIG. 3. If desired, these containers 42 and 44 can float on water and the large fish 10** can be placed upright in water to further enhance the game.

It should be noted that preferably fins 50, 52 are provided for the large fish 10 so as to provide an outrigger type of stabilization to the body of the large fish 10 so that it will float on the surface of the water with the top fin 54 upright, assuming the shark motif of FIGS. 5 and 6 is employed.

Of course, if desired, many variations of the fish swallowing game of the present invention can be employed such as by numbering the various little fish 12 and causing them to be swallowed by the big fish 10 in consecutive number, or odd number, etc. fashion or by providing time limitations during which the fish swallowing is to occur, with the object of the game being to swallow the most fish in a given time period.

Figure 10:
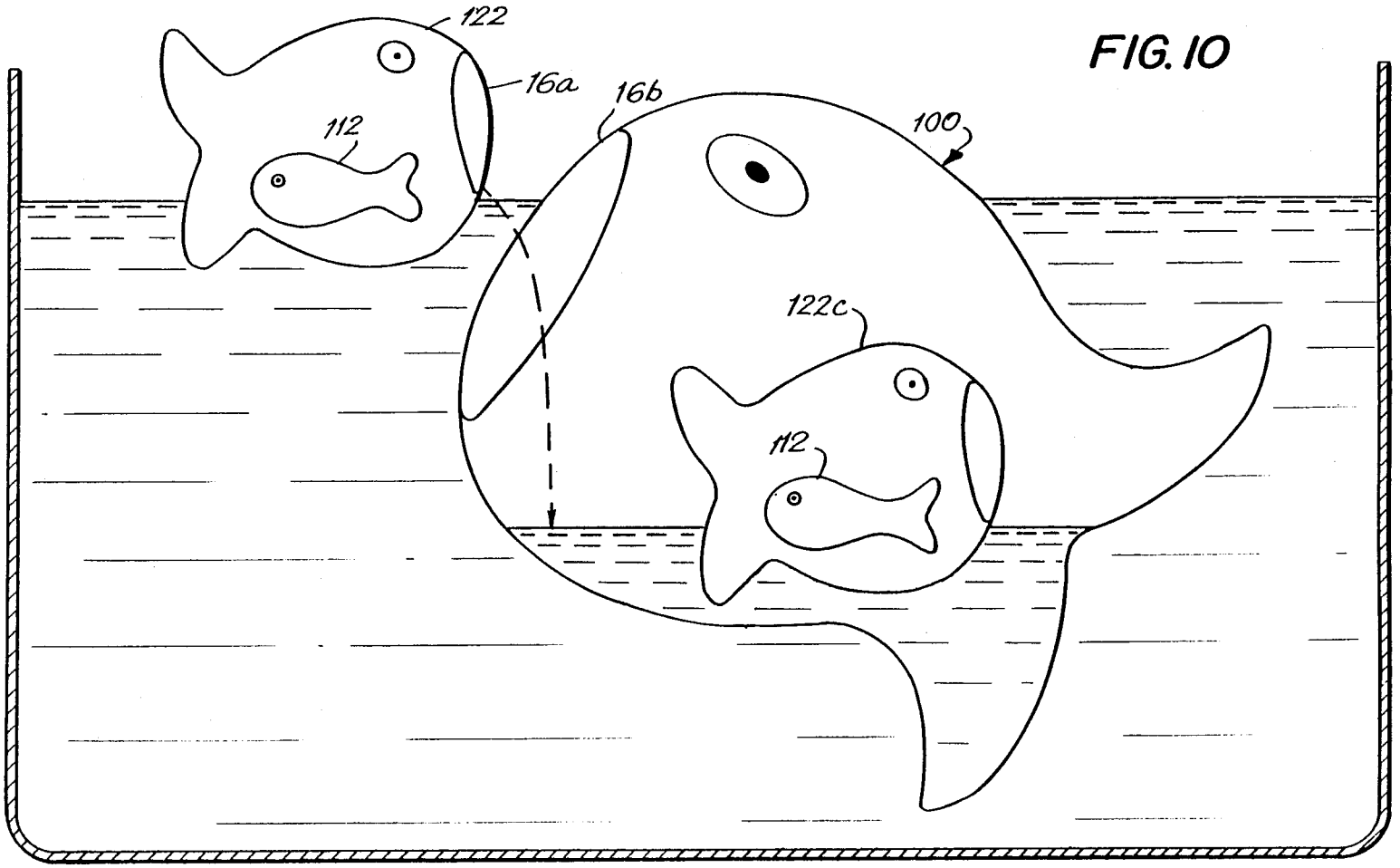
FIG. 10 is a sectional view, partially diagrammatic, similar to FIG. 1, illustrating an alternative embodiment of the presently preferred game of the present invention in which successively larger fish swallow smaller fish employing the waterfall effect of FIG. 1.

Another variation of the fish swallowing game of the present invention is shown in FIG. 10 in which successively larger fish 100 capture or swallow a smaller fish 122 after it has been used to capture or swallow a still smaller fish 112 all by using the same type of waterfall effect flow previously described with reference to FIGS. 1 and 2. Thus, in the example of FIG. 10, larger fish 122 has captured smaller fish 112 through mouth opening 16a using the waterfall effect flow previously described with reference to FIGS. 1 and 2 and then fish 122 has, in turn, been captured or swallowed by still larger fish 100 using the same type of waterfall effect flow, as represented by reference numeral 122c in FIG. 10. This step can be successively repeated with still larger fish.

What is claimed is:

1. A method of playing a fish swallowing game comprising the steps of:

placing a first hollow fish shaped receptacle in water, said first receptacle having a mouth opening from the exterior thereof into the interior thereof, with said mouth opening being placed partly depressed in said water so as to be below the level of said water and at an angle with respect thereto for collecting water therethrough, said mouth opening being partly depressed for ensuring that the water level of any collected water flowing into said first fish shaped receptacle will be below the water level of said water in which said first fish shaped receptacle has been placed for creating a waterfall effect flow of collected water from said water level of said water in which said first fish shaped receptacle has been placed to the water level of any collected water in the interior of said first fish shaped receptacle; placing a plurality of buoyant fish shaped objects in said water adjacent the exterior of said first fish shaped receptacle, each of said objects having a dimension smaller than said mouth opening for enabling passage of said object through said mouth opening; said receptacle interior being capable of holding said plurality of said fish shaped objects captured during the playing of said game; said mouth opening having a dimension slightly larger than said object dimension for restricting entry of said plurality of fish shaped objects through said mouth opening to one at a time during the playing of said game; moving said first fish shaped receptacle partly depressed restricted mouth opening adjacent one of said buoyant fish shaped objects; drawing said adjacent fish shaped object into said first receptacle hollow interior through said partly depressed restricted mouth opening along with said collected water due to said waterfall flow effect of said collected water due to the difference of said two water levels between said first receptacle exterior at said restricted mouth opening and said collected water in said first receptacle interior; whereby, said fish shaped objects may be successively swallowed one at a time by said first fish shaped receptacle.

2. A method of playing a fish swallowing game in accordance with claim 1 wherein said receptable moving step comprises the step of successively moving said fish shaped receptacle partly depressed restricted mouth opening adjacent each of said other buoyant fish shaped objects in said plurality; and said drawing step comprises the step of successively drawing each of said adjacent fish shaped objects in said plurality into said receptacle hollow interior through said partly depressed restricted mouth opening along with said collected water due to said waterfall effect of said collected water to complete capture of said plurality of objects.

3. A method of playing a fish swallowing game in accordance with claim 2 wherein said placed fish shaped receptacle comprises a funnel shaped passageway into said receptacle interior from said mouth opening.

4. A method of playing a fish swallowing game in accordance with claim 3 wherein said mouth opening is circular shaped.

5. A method of playing a fish swallowing game in accordance with claim 1 wherein said placed fish shaped receptacle comprises a funnel shaped passageway into said receptacle interior from said mouth opening.

6. A method of playing a fish swallowing game in accordance with claim 5 wherein said mouth opening is circular shaped.

7. A method of playing a fish swallowing game in accordance with claim 1 wherein said mouth opening is circular shaped.

8. A method of playing a fish swallowing game, in accordance with claim 1 wherein said first shaped object is a second hollow fish shaped receptacle having a mouth opening therein from the exterior thereof into the interior thereof.

9. A method of playing a fish swallowing game comprising the steps of:

placing a first hollow fish shaped receptacle in water, said first receptacle having a mouth opening from the exterior thereof into the interior thereof; with said mouth opening being placed partly depressed in said water so as to be below the level of said water and at an angle with respect thereto for collecting water therethrough, said mouth opening being partly depressed for ensuring that the water level of any collected water flowing into said first fish shaped receptacle will be below the water level of said water in which said first fish shaped receptacle has been placed for creating a waterfall effect flow of collected water from said water level of said water in which said first fish shaped receptacle has been placed to the water level of any collected water in the interior of said first fish shaped receptacle; said receptacle comprising a funnel shaped pasageway into said said receptacle interior from said mouth opening, said mouth opening being circular shaped; placing a buoyant fish shaped object in said water adjacent the exterior of said first fish shaped receptacle, said object having a dimension smaller than said mouth opening for enabling passage of said object through said mouth opening; moving said first fish shaped receptacle partly depressed mouth opening adjacent said buoyant fish shaped object; and drawing said adjacent fish shaped object into said first receptacle hollow interior through said partly depressed mouth opening along with said collected water due to said waterfall flow effect of said collected water due to the difference of said two water levels between said first receptacle exterior at said mouth opening and said collected water in said first receptcle interior; said fish shaped receptacle comprising a squeezable material, said drawing step further comprising the step of externally squeezing said adjacently placed receptacle for creating a partial vacuum within said receptacle interior for further aiding in drawing said adjacent fish shaped object into said receptacle interior along with said collected water; whereby, said fish shaped object is swallowed by said first shaped receptacle.

10. A method of playing a fish swallowing game comprising the steps of:

placing a first hollow fish shaped receptacle in water, said first receptacle having a mouth opening from the exterior thereof into the interior thereof, with said mouth opening being placed partly depresed in said water so as to be below the level of said water and at an angle with respect thereto for collecting water therethrough, said mouth opening being partly depressed for ensuring that the water level of any collected water flowing into said first fish shaped receptacle will be below the water level of said water in which said first shaped receptacle has been placed for creating a waterfall effect flow of collected water from said water level of said water in which said first fish shaped receptacle has been placed to the water level of any collected water in the interior of said first fish shaped receptacle; placing a buoyant fish shaped object in said water adjacent the exterior of said first fish shaped receptacle, said object having a dimension smaller than said mouth opening for enabling passage of said object through said mouth opening; moving said first fish shaped receptacle partly depressed mouth opening adjacent said buoyant fish shaped object; and drawing said adjacent fish shaped object into said first receptacle hollow interior through said partly depressed mouth opening along with said collected water due to said waterfall flow effect of said collected water due to the difference of said two water levels between said first receptacle exterior at said mouth opening and said collected water in said first receptacle interior; said fish shaped object placing step comprising the step of placing a plurality of said buoyant fish shaped objects in said water; said receptacle moving step comprising the step of successively moving said fish shaped receptacle partly depressed mouth opening adjacent each of said buoyant fish shaped objects; and said drawing step comprising the step of successively drawing each of said adjacent fish shaped objects into said receptacle hollow interior through said partly depressed mouth opening along with said collected water due to said waterfall effect of said collected water; said fish shaped receptacle comprising a squeezable material, said drawing step further comprising the step of externally squeezing said adjacently placed receptacle for creating a partial vacuum within said receptacle interior for further aiding in drawing said adjacent fish shaped object into said receptacle interior along with said collected water.

11. A method of playing fish swallowing game comprising the steps of:

placing a first hollow fish shaped receptacle in water, said first receptacle having a mouth opening from the exterior thereof into the interior thereof, with said mouth opening being placed partly depressed in said water so as to be below the level of said water and at an angle with respect thereto for collecting water therethrough, said mouth opening being partly depressed for ensuring that the water level of any collected water flowing into said first fish shaped receptacle will be below the water level of said water in which said first fish shaped receptacle has been placed to the water level of any collected water in the interior of said first fish shaped receptacle; placing a buoyant fish shaped object in said water adjacent the exterior of said first fish shaped receptacle, said object having a dimension smaller than said mouth opening for enabling passage of said object through said mouth opening; moving said first fish shaped receptacle partly depressed mouth opening adjacent said buoyant fish shaped object; and drawing said adjacent fish shaped object into said first receptacle hollow interior through said partly depressed mouth opening along with said collected water due to said waterfall flow effect of said collected water due to the difference of said two water levels between said first receptacle exterior at said mouth opening and said collected water in said first receptacle interior; said fish shaped receptacle comprising a squeezable material, said drawing step further comprising the step of externally squeezing said adjacently placed receptacle for creating a partial vacuum within said receptacle interior for further aiding in drawing said adjacent fish shaped object into said receptacle interior along with said collected water.

12. A method of playing fish swallowing game comprising the steps of:

placing a first hollow fish shaped receptacle in water, said first receptacle having a mouth opening from the exterior thereof into the interior thereof, with said mouth opening being placed partly depressed in said water so as to be below the level of said water and at an angle with respect thereto for collecting water therethrough, said mouth opening being partly depressed for ensuring that the water level of any collected water flowing into said first fish shaped receptacle will be below the water level of said water in which said first fish shaped receptacle has been placed to the water level of any collected water in the interior of said first fish shaped receptacle; placing a buoyant fish shaped object in said water adjacent the exterior of said first fish shaped receptacle, said object having a dimension smaller than said mouth opening for enabling passage of said object through said mouth opening; moving said first fish shaped receptacle partly depressed mouth opening adjacent said buoyant fish shaped object; and drawing said adjacent fish shaped object into said first receptacle hollow interior through said partly depressed mouth opening along with said collected water due to said waterfall flow effect of said collected water due to the difference of said two water levels between said first receptacle exterior at said mouth opening and said collected water in said first receptacle interior; said method further comprising the steps of removing said receptacle from said water, standing said receptacle upright on a dry land surface with said mouth opening being substantially at the top thereof, and dropping said fish shaped object into said receptacle through said mouth opening due to gravity; whereby said game may be played both in water and on dry land.

13. A method of playing a fish swallowing game in accordance with claim 12 wherein said dropping step comprises the step of successively dropping a plurality of said fish shaped objects into said receptacle through said mouth opening due to gravity.

14. A method of playing a fish swallowing game in accordance with claim 13 further comprising the step of placing an array of targets of associated point value adjacent said upright standing receptacle; and said dropping step further comprises the step of rebounding said fish shaped object off of said receptacle exterior toward said targets to score points by landing in one of said targets.

15. A method of playing a fish swallowing game in accordance with claim 12 wherein said targets comprise containers.

16. A method of playing a fish swallowing game in accordance with claim 12 further comprising the step of placing an array of targets of associated point value adjacent said upright standing receptacle; and said dropping step further comprises the step of rebounding said fish shaped object off of said receptacle exterior toward said targets to score points by landing in one of said targets.

17. A method of playing a fish swallowing game in accordance with claim 16 wherein said targets comprise containers.

18. A method of playing fish swallowing game comprising the steps of:

placing a first hollow fish shaped receptacle in water, said first receptacle having a mouth opening from the exterior thereof into the interior thereof, with said mouth opening being placed partly depressed in said water so as to be below the level of said water and at an angle with respect thereto for collecting water therethrough, said mouth opening being partly depressed for ensuring that the water level of any collected water flowing into said first fish shaped receptacle will be below the water level of said water in which said first fish shaped receptacle has been placed to the water level of any collected water in the interior of said first fish shaped receptacle; placing a buoyant fish shaped object in said water adjacent the exterior of said first fish shaped receptacle, said object having a dimension smaller than said mouth opening for enabling passage of said object through said mouth opening; moving said first fish shaped receptacle partly depressed mouth opening adjacent said buoyant fish shaped object; and drawing said adjacent fish shaped object into said first receptacle hollow interior through said partly depressed mouth opening along with said collected water due to said waterfall flow effect of said collected water due to the difference of said two water levels between said first receptacle exterior at said mouth opening and said collected water in said first receptacle interior; said method further comprising placing a second hollow fish shaped receptacle in water larger than said first hollow fish shaped receptacle said second receptacle having a mouth opening from the exterior thereof into the interior thereof, with said mouth opening being placed partly depressed in said water so as to be below the level of said water and at an angle with respect thereto for collecting water therethrough, said second receptacle mouth opening being partly depressed for ensuring that the water level of any collected water flowing into said second fish shaped receptacle will be below the water level of said water in which said second fish shaped receptacle has been placed for creating a waterfall effect flow of collected water from said water level of said water in which said second fish shaped receptacle has been placed to the water level of any collected water in the interior of said second fish shaped receptacle, said second fish shaped receptacle being placed in said water adjacent the exterior of said first fish shaped receptacle after said buoyant fish shaped object has been drawn into said first fish shaped receptacle hollow interior, said mouth opening being sized for enabling passage of said first hollow fish shaped receptacle therethrough, moving said second fish shaped receptacle partly depressed mouth opening adjacent said first fish shaped receptacle having said buoyant fish shaped object within its hollow interior; and drawing said first fish shaped receptacle into said second receptacle hollow interior through said partly depressed mouth opening along with said collected water due to said waterfall flow effect of said collected water due to the difference of said two water levels between said second receptacle exterior at said mouth opening and said collected water in said second receptacle interior; whereby, said fish swallowing method may be successively repeated with successively larger fish shaped receptacle.

19. A method of playing a shaped object swallowing game comprising the steps of:

placing a hollow receptacle in water, said receptacle having a mouth opening from the exterior thereof into the interior thereof, with said mouth opening being placed partly depressed in said water so as to be below the level of said water and at an angle with respect thereto for collecting water therethrough, said mouth opening being partly depressed for ensuring that the water level of any collected water flowing into said receptacle will be below the water level of said water in which said receptacle has been placed for creating a waterfall effect flow of collected water from said water level of said water in which said receptacle has been placed to the water level of any collected water in the interior of said receptacle; placing a plurality of buoyant defined shaped objects in said water adjacent the exterior of said receptacle, each of said shaped objects having a dimension smaller than said mouth opening for enabling passage of said shaped object through said mouth opening; said receptacle interior being capable of holding said plurality of said shaped objects captured during the playing of said game; said mouth opening having a dimension slightly larger than said object dimension for restricting entry of said plurality of shaped objects through said mouth opening to one at a time during the playing of said game; moving said receptacle partly depressed restricted mouth opening adjacent one of said buoyant shaped objects drawing said adjacent shaped object into said receptacle hollow interior through said partly depressed restricted mouth opening along with said collected water due to said waterfall flow effect of said collected water due to the difference of said two water levels between said receptacle exterior at said restricted mouth opening and said collected water in said receptacle interior; whereby, said shaped objects may be successively swallowed one at a time by said receptacle during the playing of said game.

20. A method of playing an object swallowing game in accordance with claim 19 wherein said plurality of shaped objects have differing point values.

* * * * *